US006655051B1

(12) United States Patent
Peche et al.

(10) Patent No.: US 6,655,051 B1
(45) Date of Patent: Dec. 2, 2003

(54) APPLIANCE FOR PROTECTING AGAINST THE EFFECTS OF EXPLOSIVE DEVICES

(75) Inventors: Jean Patrick Peche, Cergy (FR); Renaud Gaultier, Paris (FR); Marc-Olivier Peltzer, Boulogne-Billancourt (FR)

(73) Assignee: Anonymate, Cergy (FR)

( * ) Notice: Subject to any disclaimer, the term of this patent is extended or adjusted under 35 U.S.C. 154(b) by 0 days.

(21) Appl. No.: 09/914,012

(22) PCT Filed: Feb. 21, 2000

(86) PCT No.: PCT/FR00/00429

§ 371 (c)(1),
(2), (4) Date: Sep. 12, 2001

(87) PCT Pub. No.: WO00/50837

PCT Pub. Date: Aug. 31, 2000

(65) Prior Publication Data

(65)

(30) Foreign Application Priority Data

Feb. 22, 1999 (FR) ..... 99 02150

(51) Int. Cl.[7] ..... A43B 13/16

(52) U.S. Cl. ..... 36/103; 36/113; 36/25 R; 36/72 R

(58) Field of Search ..... 36/107, 113, 116, 36/103, 25 R, 72 R, 72 A

(56) References Cited

U.S. PATENT DOCUMENTS

| | | | | | |
|---|---|---|---|---|---|
| 2,205,073 | A | * | 6/1940 | Smit | 36/59 C |
| 3,032,894 | A | * | 5/1962 | Kennedy | 36/1 |
| 3,243,898 | A | | 4/1966 | Lewis, Jr. et al. | |
| 3,318,024 | A | * | 5/1967 | Fujinaka et al. | 36/85 |
| 3,516,181 | A | | 6/1970 | Jordan | |
| 4,137,653 | A | * | 2/1979 | Famolare, Jr. | 36/3 B |
| 6,006,646 | A | * | 12/1999 | Makris et al. | 36/7.5 |

FOREIGN PATENT DOCUMENTS

| | | |
|---|---|---|
| GB | 2 191 384 A | 12/1987 |
| WO | WO 97/04675 | 2/1997 |

* cited by examiner

*Primary Examiner*—Ted Kavanaugh
(74) *Attorney, Agent, or Firm*—Oliff & Berridge, PLC

(57) ABSTRACT

An appliance for protecting the bottom end of a human lower limb, and in particular the foot, from propagation of the blast wave and the heat generated by an explosive device of the mine type exploding. The invention provides an ammunition type boot whose sole is constituted by an assembly comprising a dispersion boat-shape, an antifire barrier, and support studs. The assembly provides simultaneously an optimum dispersion effect and satisfactory use for walking and running on any type of ground. It also withstands the explosion, and the heat, and it does not create puncturing projectiles because it constitutes a homogeneous assembly.

13 Claims, 1 Drawing Sheet

APPLIANCE FOR PROTECTING AGAINST THE EFFECTS OF EXPLOSIVE DEVICES

Figure 1:
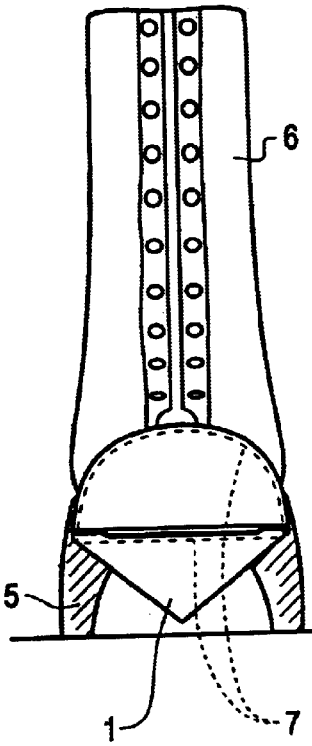

The invention relates to a boot serving simultaneously to protect the lower limbs of humans against the deflagration of explosive devices of the antipersonnel mine type, and to allow a person to walk or run on any type of terrain.

PRESENT STATE OF THE ART

The present state of the art presents two types of protection for the lower limbs against the deflagration of explosive devices:

Rigid armoring (armored soles mounted on a walking boot) which make walking possible while providing protection against shrapnel but which are ineffective against the energy conveyed by the blast wave and the shock wave, which waves give rise to the major portion of the destructive effects leading to irreparable lesions in man and often leading to amputation.

Appliances for dispersing the blast waves. Dispersion is performed by the geometrical shape of the sole, referred to below as a "boat-shape", which is generally in the form of a triangular or wedge-shaped prism with a downwardly-directed ridge or "keel" formed by two faces of the dispersion boat-shape meeting. These boat-shapes are fixed to the bottom portion of a boot and present the following characteristics:

either they are incorporated in a rigid mass to make walking possible, but the dispersion effect is then considerably reduced. The plane surface created in this way transmits practically all of the effects of the blast wave.

In addition, the mass covering the boat-shape will be broken into pieces that (depending on the material concerned) can constitute puncturing projectiles that give rise to lesions. (This applies to patent GB 2 191 384 to Dalzell, Goldsmith, and Hudson, and to U.S. Pat. No. 3,143,898 to Lewis and Holland);

or the boat-shape is left in the air and fitted with a "skate" type support beneath the ridge of the prism. The skate is unsuitable for balanced walking or for use on all types of terrain. (This applies to U.S. Pat. No. 3,516, 181 to Jordan);

the above-mentioned boat-shapes suffer from another drawback: like an orthosis, they are fixed beneath a walking boot by straps or belts attached by buckles (Lewis, Dalzell, and Jordan patents). The assembly comprising the boot and the protective appliance thus does not constitute an assembly that is homogeneous and integral. Thus, in the event of deflagration, the protection appliance is torn away and becomes a projectile causing additional injuries:

finally, none of those appliances provides protection against the flame of the explosion. For example, the temperature can reach 4000° C. during the initial stage of an explosion.

DESCRIPTION OF THE INVENTION

An object of the invention is to mitigate this incompatibility between the shape of the dispersive appliance and the need to make a boot can be used under any type of circumstance and on any type of terrain.

To achieve this object, a boot has integrated therein a geometrical shape of the boat-shape type with its keel formed by two faces of the dispersion boat-shape being directed towards the ground and left in the open air. This boat-shape disperses the major fraction of the blast wave and the heat of the explosion. Stabilizer elements are incorporated in the assembly so as to enable the assembly to be stabilized relative to the ground and thus allow natural walking and running on any type of terrain. The boot is produced in the form of a homogeneous assembly that can be used without fitting any detachable elements.

The appliance of the invention is an ammunition type boot, whose sole is constituted by a boat-shaped assembly with supporting studs and an antifire barrier. The assembly provides simultaneously an optimum dispersing effect, effective protection against heat, and satisfactory use in walking and running on any type of terrain. It also withstands the explosion and does not create puncturing projectiles because it is constituted by a homogeneous assembly.

The appliance of the present invention preferably presents the following characteristics:

The purpose of the first characteristic is to stabilize the boot relative to the ground. This is done by adding supports to the boat-shape. These supporting "studs", "props", or "spikes" are assembled to both faces of the boat-shape so that its bottom keel is perpendicular to the ground. The studs extend perpendicularly to the general axis of the keel of the boat-shape.

The purpose of the second characteristic is to provide proper support for a walker. This is done by a particular disposition of the supporting studs. These are disposed to correspond with the anatomical supporting surfaces of the foot, at the toe and heel ends of the boot. The toe end studs are situated beneath the big toe and the ball of the foot; the heel end studs are situated beneath the talus.

The purpose of the third characteristic is to allow the boat-shape to act fully in deflecting the blast wave, This is ensured by the supporting studs being thin. In the invention, the total area of the studs represents 15% to 35% of the area of the sole. The boat-shape thus remains visible over at least three-quarters of its bottom surface area.

Figure 3:
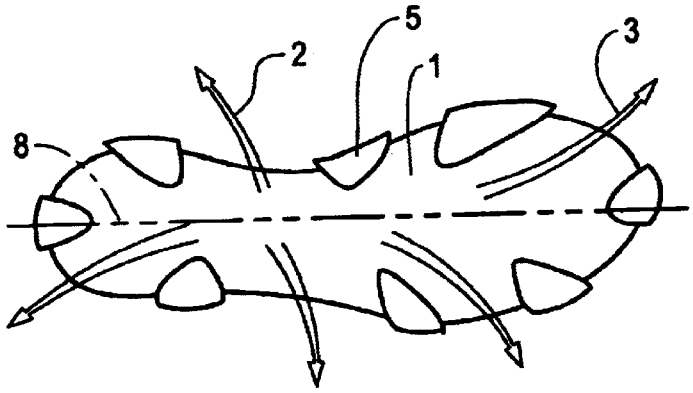

The purpose of the fourth characteristic is to enable the boat-shape to act fully in deflecting the blast wave. This is achieved by the tapering shape of the support studs as shown in FIG. 3. The studs are perpendicular to the keel of three boat-shape and they are distributed along it (characteristics 1 and 2). Consequently during an explosion, the first obstacle encountered by the deflected blast wave will be the support studs. These brake the blast wave. To limit this effect, the studs must be of a shape that provides as small an obstacle as possible to the blast wave. This is done by means of a streamlined shape as shown in FIG. 3.

The purpose of the fifth characteristic is to is reinforce the deflection effect of the boat-shape and the studs acting together. This is provided by selecting composite materials of different stiffness for making them. The boat-shape must be rigid in order to withstand the blast of the explosion and thus deflect it. The studs must be destroyed immediately.

The purpose of a sixth characteristic is to avoid creating puncturing projectiles when the studs are destroyed by the blast of the explosion. This is provided by using non-rigid material for making them. Such material should have hardness on the Shore scale lying in the range 40 to 80. It can be made up of polyurethane resin or any other material presenting such characteristics.

The purpose of a seventh characteristic is to provide protection from the flame of the explosion. This is done by combining the dispersing effect of the boat-shape (characteristics 3 to 5) with antifire barrier included in the boat-shape and in the upper of the boot.

The preferred location for the antifire barrier is inside the boat-shape(preferably under the arch of the foot) and in the material constituting the upper of the boot. By way of illustration, antifire barriers tested on conventional soles were destroyed. Similarly, boat-shapes without an antifire barrier behave in much less satisfactory manner than those so equipped. It is therefore this combination which provides the best protection.

The purpose of an eighth characteristic is to obtain a protective boot that is homogeneous. This is achieved by integrating the top portion of the boot, the insole, the boat-shape, and the studs in an overall assembly by a preferred implementation. The result is a homogeneous structure which presents excellent resistance to blast of the explosion while allowing the boat-shape to perform its function because it is visible and rigid (characteristics 3 to 5) and because it remains secured to the boot during an explosion.

Preferred Implementation

The upper subassembly (i.e. the top portion of the boot) is stuck to the boat-shape subassembly.

The resulting assembly is then placed in a mold for injecting polyurethane resin.

The mold is closed.

Molten polyurethane resin is injected. Injection makes it possible to produce the support studs and to weld all the subassemblies together.

After cooling, the boot is unmolded.

Secondary Implementations

Two secondary implementations have been identified.

Secondary implementation No. 1

As in the preferred implementation, the upper and the boat-shape subassemblies are stuck together.

Then the stud subassembly is made separately by injection molding polyurethane resin.

The boot is then assembled by adhesive.

Secondary Implementation No. 2

As in the preferred implementation, the upper and the boat-shape subassemblies are stuck together.

The studs are made individually by being cut out from elastomer plates.

The studs are subsequently assembled to the upper/boat-shape assembly by adhesive.

ACCOMPANYING DRAWINGS

The accompanying drawings illustrate the invention

FIG. 1 is a section through the invention and shows the component parts of the boot:

a dispersion boat-shape (1);

support studs (5) for stabilizing the assembly is relative to the ground;

an antifire barrier (7) situated in the dispersion boat-shape under the arch of the foot and also in the upper of the boot; and the upper of the boot (6).

Figure 2:
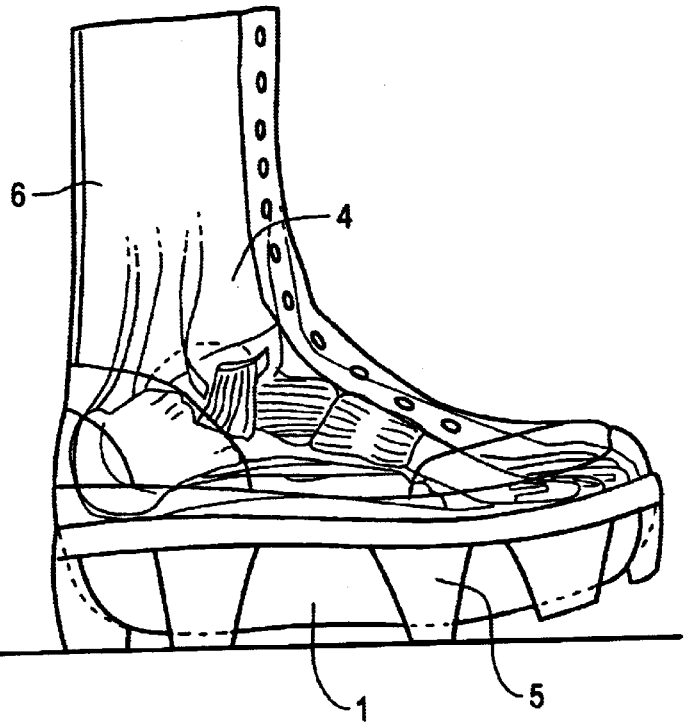

FIG. 2 shows the invention in profile and illustrates its ergonomic aspects:

the foot (4) is held in the upper of the boot (6) and is situated above the dispersion boat-shape (1) assembled to the support studs (5);

to make walking easier, the studs (S) are distributed along the boat-shape and include toe end and heel end supports; and the heel end studs are situated beneath the talus and the toe end studs beneath the toes and the ball of the foot. This disposition provides the user with good support.

FIG. 3 shows the invention seen from beneath and illustrates its blast wave dispersing characteristics:

the blast wave is deflected (2 and 3) along the bottom faces of the boat-shape (1);

the tapering shape of the studs (5) should offer as little resistance as possible to the blast of the explosion; end for this purpose, the leading edges of the tapering volumes of these studs are positioned perpendicularly to the general axis of the keel of the boat-shape (8).

What is claimed is:

1. An appliance for protecting a bottom end of a human lower limb from a propagation of a blast wave and from heat generated by an explosive device of a mine type exploding, the appliance comprising:

a boot including:

an upper;

a boat-shape type sole, with a keel formed by two faces of the boat-shape facing towards the ground and left in open air so as to disperse a major fraction of the blast wave and the heat of the explosion; and support studs incorporated in the sole around the boat-shape, enabling the sole to be stable on the ground and also making natural walking and running possible on all types of terrain, said studs each having a free end, said boot constituting a homogeneous assembly usable without fitting detachable elements, and integrating in its structure the upper of the boot, the deflection boat-shape, and the support studs for walking, wherein said keel is located above the free end of the support studs.

2. An appliance according to claim 1, wherein the support studs comprise vertically extending tapering volumes with leading edges situated perpendicularly to the general axis of the keel of the deflection boat-shape.

3. An appliance according to claim 1, wherein the support studs are disposed in register with the anatomical supports of the foot; the toe end studs being situated beneath the ball of the foot and the big toe; the heel end studs being situated beneath the talus.

4. An appliance according to claim 1, wherein the support studs are thin, having a total area representing 15% to 35% of the area of the sole, thus leaving the boat-shape apparent over at least three-fourths of its surface area.

5. An appliance according to claim 1, wherein the support studs are of tapering shape so as to offer as little resistance as possible to the blast wave and so as to disperse it better along the boat-shape.

6. An appliance according to claim 1, wherein the boat-shape is made of rigid composite material so as to provide good resistance to the explosion, and thus better dispersion.

7. An appliance according to claim 1, wherein the support studs are made of non-rigid composite materials having hardness on the Shore scale lying in the range 40 to 80, in order to avoid creating puncturing projectiles when the support studs are destroyed by the explosion.

8. An appliance according to claim 1, for protecting the foot of a human.

9. An appliance according to claim 1, wherein the boat-shape type sole extends substantially over the entire length of the appliance.

10. An appliance according to claim 1, the boat-shape being in the form of at least one of a triangular shape and wedge-shaped prism.

11. An appliance according to claim 1, the keel being formed by an intersection of two faces of the dispersion boat-shape.

12. A method of manufacturing an appliance according to claim 1, the method comprising the following steps:

sticking a subassembly comprising the upper to a subassembly comprising the boat-shape;

placing the resulting assembly in a mold for injecting polyurethane resin;

closing the mold;

injecting molten polyurethane resin to produce the support studs and to weld all the subassemblies together; and unmolding the boot after it has cooled.

13. The method of manufacturing an appliance according to claim 12, further comprising using the appliance to make an ammunition boot.

* * * * *